US008083104B2

(12) United States Patent
Roetker et al.

(10) Patent No.: US 8,083,104 B2
(45) Date of Patent: Dec. 27, 2011

(54) VARIABLE TEMPERATURE DISPENSER SYSTEM AND METHOD

(75) Inventors: John J. Roetker, Louisville, KY (US); Carl T. Whitaker, Loveland, CO (US)

(73) Assignee: General Electric Company, Schenectady, NY (US)

( * ) Notice: Subject to any disclaimer, the term of this patent is extended or adjusted under 35 U.S.C. 154(b) by 1023 days.

(21) Appl. No.: 11/963,444

(22) Filed: Dec. 21, 2007

(65) Prior Publication Data

US 2009/0159611 A1 Jun. 25, 2009

(51) Int. Cl.
*B67D 7/80* (2010.01)

(52) U.S. Cl. ..... 222/146.1; 222/1; 222/54; 222/129.1; 222/145.5; 222/146.2; 222/146.6; 62/389; 62/390

(58) Field of Classification Search ..... 222/145.1, 222/129, 146.1, 146.2, 146.6, 145.5, 129.1, 222/129.4, 1, 54, 144.5; 62/389–390
See application file for complete search history.

(56) References Cited

U.S. PATENT DOCUMENTS

| | | | | |
|---|---|---|---|---|
| 2,031,599 | A | 2/1936 | Gudmundsen | |
| 3,634,107 | A * | 1/1972 | Cornelius | 99/275 |
| 4,792,059 | A * | 12/1988 | Kerner et al. | 222/67 |
| 5,833,096 | A * | 11/1998 | Ohu | 222/146.1 |
| 5,858,437 | A * | 1/1999 | Anson | 426/431 |
| 5,889,684 | A * | 3/1999 | Ben-David et al. | 700/282 |
| 5,975,365 | A * | 11/1999 | Hsieh | 222/129.4 |
| 6,101,835 | A * | 8/2000 | Butsch et al. | 62/390 |
| 6,207,046 | B1 * | 3/2001 | Yamashita et al. | 210/138 |
| 6,460,735 | B1 * | 10/2002 | Greenwald et al. | 222/146.1 |
| 6,532,758 | B2 * | 3/2003 | DuHack | 62/340 |
| 6,636,151 | B2 | 10/2003 | Busick | |
| 7,207,189 | B2 * | 4/2007 | An et al. | 62/339 |
| 7,210,601 | B2 | 5/2007 | Hortin et al. | |
| 7,401,545 | B2 * | 7/2008 | Hu et al. | 99/281 |
| 7,458,520 | B2 * | 12/2008 | Belz et al. | 236/12.12 |
| 7,654,191 | B2 * | 2/2010 | Greenwald et al. | 99/275 |
| 2005/0268639 | A1 | 12/2005 | Hortin et al. | |

FOREIGN PATENT DOCUMENTS

GB 693 748 A 7/1953

* cited by examiner

*Primary Examiner* — Frederick C. Nicolas
(74) *Attorney, Agent, or Firm* — Fay Sharpe LLP

(57) ABSTRACT

A variable temperature dispensing system and method for dispensing a variable temperature controlled fluid in an appliance includes a first fluid storage tank for holding the fluid at one temperature and a second fluid storage tank for holding the fluid at another temperature that is elevated relative to the one temperature of the first fluid storage tank. A dispenser outlet is fluidly connected to the first and second fluid storage tanks by at least one fluid line. A proportioning device is disposed along the at least one fluid line between the dispenser outlet and the first and second fluid storage tanks to proportion the fluid delivered from the first and second fluid storage tanks to the dispenser outlet. The proportioning device allows for the selection of a specific temperature for the fluid to be dispensed through the dispenser outlet and delivers the fluid at the selected specific temperature.

18 Claims, 5 Drawing Sheets

VARIABLE TEMPERATURE DISPENSER SYSTEM AND METHOD

BACKGROUND

The present disclosure generally relates to dispensing systems, and more particularly relates to a variable temperature dispenser system and method for dispensing a variable temperature controlled fluid. In one embodiment, a variable temperature water dispenser system is provided for dispensing water from a refrigerator. In this embodiment, the system includes a hot water tank for holding water at a first temperature, a cold water tank for holding water at a second, lower temperature and a dispenser outlet for dispensing proportioned amounts of water from the hot and cold water tanks. The dispensing system and method will be described with particular reference to this embodiment, but it is to be appreciated that it is also amenable to other like applications.

By way of background, appliances, such as refrigerators, sometimes include a water dispensing system having a single water storage tank for storing and cooling water to be dispensed. Further, some refrigerator water dispensing systems include a water filter connected to the water storage tank and located in a fresh food or freezer food compartment of the refrigerator. Conventional water dispensing systems, whether disposed in an appliance or otherwise (e.g., under a sink) are usually concerned with the dispensing of cooled water.

SUMMARY

According to one aspect, a variable temperature dispenser system for dispensing a fluid is provided. More particularly, in accordance with this aspect, the system includes a first fluid storage tank for holding the fluid at one temperature and a second fluid storage tank for holding the fluid at another temperature that is elevated relative to the one temperature of the first fluid storage tank. A dispenser outlet is fluidly connected to the first and second fluid storage tanks by at least one fluid line. A proportioning device is disposed along the at least one fluid line between the dispenser outlet and the first and second fluid storage tanks to proportion the fluid delivered from the first and second fluid storage tanks to the dispenser outlet.

According to another aspect, a variable temperature water dispenser system is provided for dispensing water from a refrigerator. More particularly, in accordance with this aspect, the system includes a hot water tank for holding water at a first temperature, a cold water tank for holding water at a second, lower temperature, and a dispenser outlet for dispensing proportioned amounts of water from the hot and cold water tanks. Dispenser fluid lines fluidly connect the hot and cold water tanks to the dispenser outlet. A proportioning device is fluidly disposed between each of the hot and cold water tanks and the dispenser outlet for proportioning the respective amounts of water dispensed at the dispenser outlet from the hot and cold water tanks.

According to yet another aspect, a method for dispensing a variable temperature controlled fluid in an appliance is provided. More particularly, in accordance with this aspect, a specific temperature is selected for water to be dispensed through a dispenser outlet from a hot water tank and a cold water tank. Water from the hot water tank and the cold water tank is proportioned to deliver the water at the dispenser outlet at the specific temperature.

DETAILED DESCRIPTION

Figure 1:
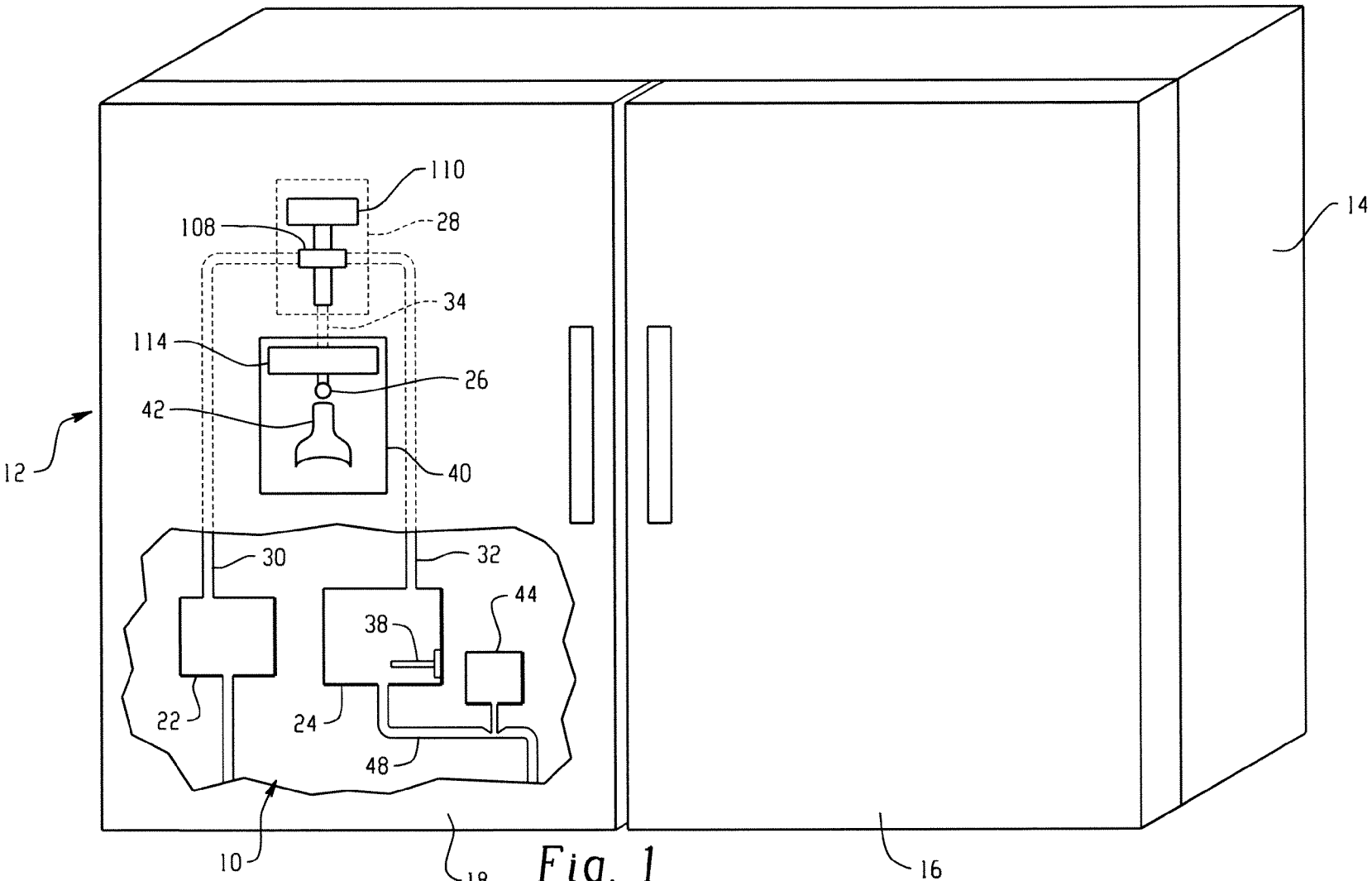
FIG. 1 is schematic perspective view of a refrigerator, with a portion of one of the refrigerator's doors removed to reveal first and second fluid storage tanks disposed therein and forming part of a variable temperature dispenser system for dispensing a variable temperature controlled fluid from the refrigerator.

Referring now to the drawings wherein the showings are for purposes of illustrating one or more exemplary embodiments, FIG. 1 shows a variable temperature dispenser system for dispensing a fluid (e.g., water), the system being generally designated by reference numeral 10. In the illustrated embodiment, the system 10 is employed within a refrigerator 12, but it is to be appreciated that the system 10 could be disposed in or used in association with any other type of appliance, or the system 10 could be provided independent of an appliance.

The illustrated refrigerator 12 is shown as a side-by-side refrigerator, such as the type having refrigerated and freezer compartments arranged in side-by-side relation relative to one another. However, it is to be appreciated that when the system 10 is disposed within or used in association with an appliance that is a refrigerator, the refrigerator need not be of the illustrated type. For example, the refrigerator in which the system 10 is disposed can be a side-by-side refrigerator with a bottom freezer drawer or compartment, the refrigerator could have only a single door, or could be of some other configuration or type.

The side-by-side refrigerator 12 of the illustrated embodiment includes a main refrigerator cabinet or casing 14, which can define a fresh food storage compartment and a freezer storage compartment (neither compartment shown) arranged in side-by-side relation relative to one another. The refrigerator 12 can also include doors 16,18 disposed respectively over the fresh and freezer storage compartments. For example, door 16 can be provided over the refrigerated compartment for providing selective access thereto and door 18 can be likewise provided over the freezer compartment.

In the illustrated embodiment of FIG. 1, the system 10 is largely disposed within the door 18 over the freezer compartment, though this is not required. The system 10 includes a first fluid storage tank 22 for holding fluid, such as water, at one temperature and a second fluid storage tank 24 for holding fluid at another temperature that is elevated relative to the one temperature of the tank 22. In FIG. 1, the tanks 22,24 are shown as disposed with the door 18 of the refrigerator 12, though this is not required. When the fluid of the system 10 is water, the second fluid storage tank 24 can be a hot water tank for holding the water at a first temperature (e.g., 100° C.) and the first fluid storage tank can be a cold water tank for holding water at a second, lower temperature (e.g., 10° C.). Additionally, when the fluid is water, the system 10 can be referred to as a variable temperature water dispenser system. Of course, it should be appreciated that the fluid need not be limited to water and thus could be some other fluid capable of being dispensed by the system 10 as will be described in more detail below.

As shown schematically in FIG. 1, the tanks 22,24, which can be stainless steel, are fluidly connected to a dispenser outlet 26 by at least one fluid line. The dispenser outlet 26 provided to dispense proportioned amounts of fluid from the tanks 22,24 as will be described in more detail below. In addition, a proportioning device 28 is fluidly disposed along the at least one fluid line between the dispenser outlet 26 and the tanks 22,24 to proportion fluid delivered from the tanks to the dispenser outlet. More particularly, in the illustrated embodiment, the at least one fluid line is a plurality of dispenser fluid lines, including line 30 fluidly connecting the tank 22 to the proportioning device 28, line 32 fluidly connecting the tank 24 to the proportioning device 28, and line or line portion 34 fluidly connecting the proportioning device 28 to the outlet 26. Thus, the proportioning device 28 is fluidly disposed between each of the tanks 22,24 and the dispenser outlet 26 for proportioning respective amounts of fluid dispensed at the dispenser outlet 26 from the tanks 22,24. In the embodiment shown in FIG. 1, the proportioning device 28 is shown (schematically) as being disposed in the door 18, though this is not required.

The dispenser outlet 26 can be disposed on the door 18 of the refrigerator 12. For example, as shown in the illustrated embodiment of FIG. 1, the dispenser outlet 26 is disposed within a dispenser recess 40 defined in door 18. Alternately, the dispenser outlet 26 can be provided in some other location of the refrigerator 12, or any desirable location in some other type of appliance (or simply mounted in a desirable location when the system 10 is used independently of an appliance). The system 10 can further include a dispenser actuator 42 provided in association with the dispenser outlet 26 for generating a dispense signal (e.g., signal 74 of FIG. 2) upon actuation of the actuator 42. As is known and understood by those skilled in the art, and as is shown schematically in FIG. 1, the actuator 42 can be a push button or a lever disposed immediately behind the outlet 26 in the recess 40 and is actuated by positioning a glass or cup under the outlet 26 and pressing against the actuator 42. In other configurations, the actuator 42 can simply be a button or other device that produces a dispense signal upon actuation thereof.

The tank 24 can include a heating device 38 for heating the fluid contained therein to a predetermined temperature (e.g., 100° C.). For handling expansion of the fluid within the tank 24 as the fluid is heated, the system 10 additionally includes an expansion compensating device 44. More particularly, as will be described in more detail below, the expansion compensating device 44 compensates for expansion of fluid in the tank 24 when this fluid is heated by the heating device 38. As shown, the expansion compensating device 44 can be disposed fluidly upstream of the tank 24. In one embodiment, the expansion compensating device 44 is or includes a retraction tank defining an expansion chamber, all disposed upstream of the tank 24 along fluid line 48. In addition to compensating for expansion, the device 44 can also function to remove residual fluid from the fluid lines, including lines 30, 32 and 34, which can ensure that fluid later delivered to the dispenser outlet 26 is at a desired temperature (i.e. there is no or little residual fluid at some unknown temperature receiving downstream of the tanks 22,24) and help prevent any dribbling at the outlet 26.

Figure 2:
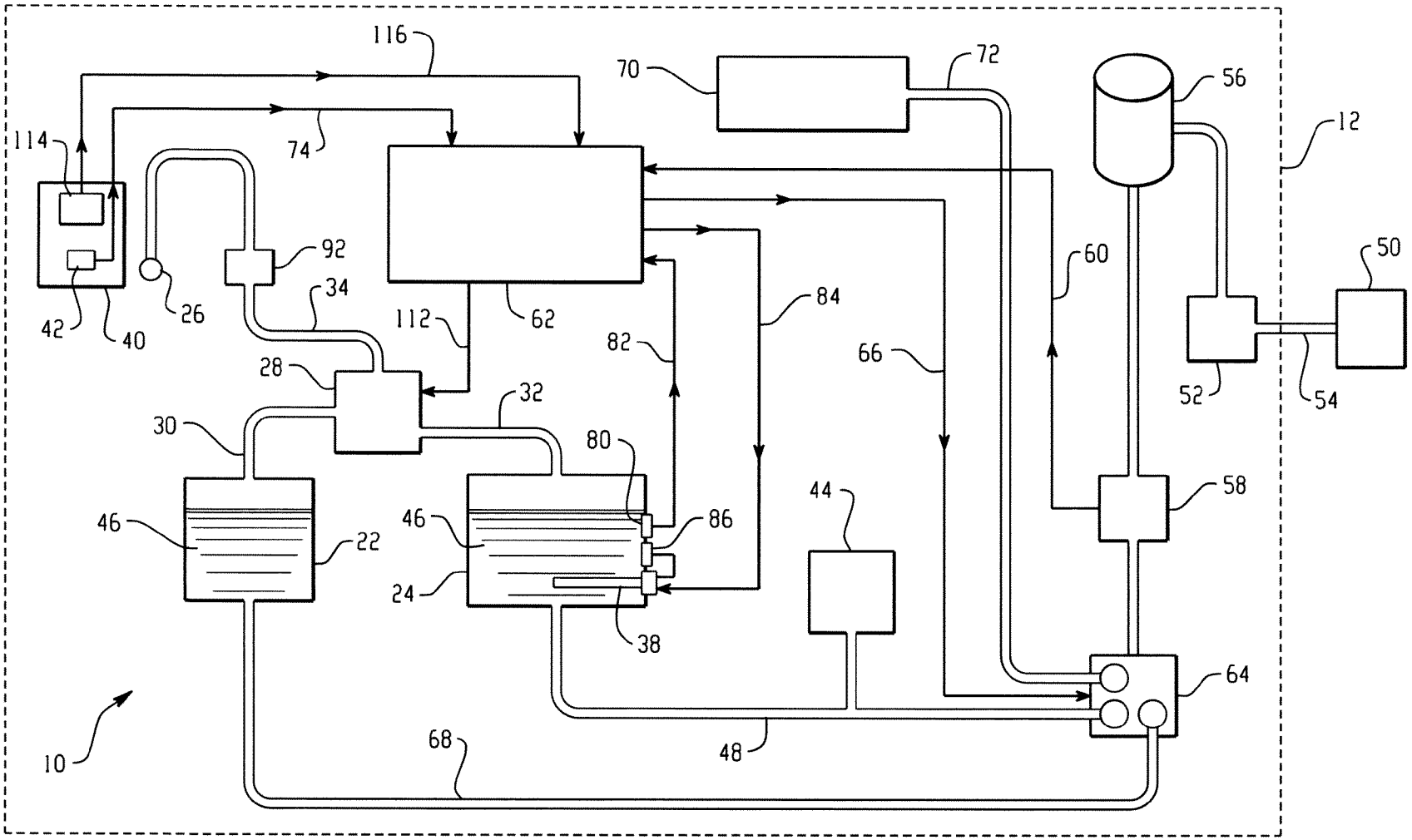
FIG. 2 is a schematic view of the system of FIG. 1 showing the hot and cold water tanks fluidly coupled to a dispenser outlet through a proportioning device, and showing an expansion compensating device upstream of a hot water tank.

With additional reference now to FIG. 2, the system 10 receives its fluid (e.g., fluid 46) from a pressurized fluid source 50, such as a municipal water supply line or connection. An inlet coupling 52 of the refrigerator 50 is fluidly connected to the pressurized fluid source 50 by a conventional fluid line 54. If desired, fluid entering the refrigerator 12 through the inlet coupling 52 can be passed through a filter 56 disposed toward an upper end of the refrigerator cabinet 14. From the filter 56, the fluid entering the refrigerator can be passed through a flow meter 58 which generates a flow signal 60 representative of the rate of flow thereby and sends the signal 60 to a controller 62. The controller 62 can use the signal 60 to provide a precisely measured or metered dispense at the outlet 26 as is known and understood by those skilled in the art.

From the flow meter 58, the fluid is directed to a supply valve 64, which can be controlled by the controller 62 via command signal 66. The supply valve 64, when commanded by the controller 62, sends fluid from the fluid source 50 to the tank 22 along fluid line 68, to the tank 24 along the fluid line 48, and optionally to one or more auxiliary devices, such as ice maker 70 along fluid line 72. In particular, the controller 62 can operate the inlet valve 64 to allow fluid to pass to the tanks 22,24 via lines 48,68 when the dispenser actuator 42 is actuated as indicated to the controller 62 by signal 74. As is known and understand by those skilled in the art, the lines 48,68 can run through hinges of the door 18 (e.g., bottom hinges) to get the fluid to the tanks 22,24 when disposed in a door (e.g., door 18). Of course, it should be appreciated that other arrangements of fluid lines can be successfully employed in the system 10.

With reference back to FIGS. 1 and 2, the heating device 38 of the tank 24 can be a heat rod, as illustrated, or some other heating device, that heats the fluid 46 in the tank 24 to the first temperature (e.g., 100° C.). Operation of the heating device 38 can be done by the controller 62. More particularly, a thermostatic sensor 80, such as a thermistor, can sense the temperature of the fluid 46 in the tank 24 and indicate the sensed temperature to the controller 62 via signal 82. Using signal 82, the controller 62 can cycle the heating device 38 via command signal 84 to maintain the fluid 46 in the tank 24 at the desired temperature. A cutout device 86 can be provided on the tank 24 in association with the heating device 38 for preventing actuation of operation of the heating device 38 when the temperature in the tank 24 is above a predetermined temperature threshold, for example, 105° C. In one embodiment, the temperature cutout device 86 is a bi-metal switch that disables the heating element 38 when the temperature in the tank 24 is above the predetermined temperature threshold and requires manual resetting after activation, though this is not required.

Fluidly disposed between the dispenser outlet 26 and the proportioning device 28 (i.e., downstream of the proportioning device 28) and preferably adjacent the dispenser outlet 26, is an expansion chamber or device 92 that purges any air trapped in the line 34 prior to dispensing fluid through the dispenser outlet 26. The expansion chamber 92 can simply be an expanded portion or area along the line 34 that prevents air gaps possibly contained within fluid of the line 34 from intermittently reaching the dispenser outlet 26 (i.e., causing spitting) and thereby allows for continuous flow of fluid at the outlet 26.

Figure 3:
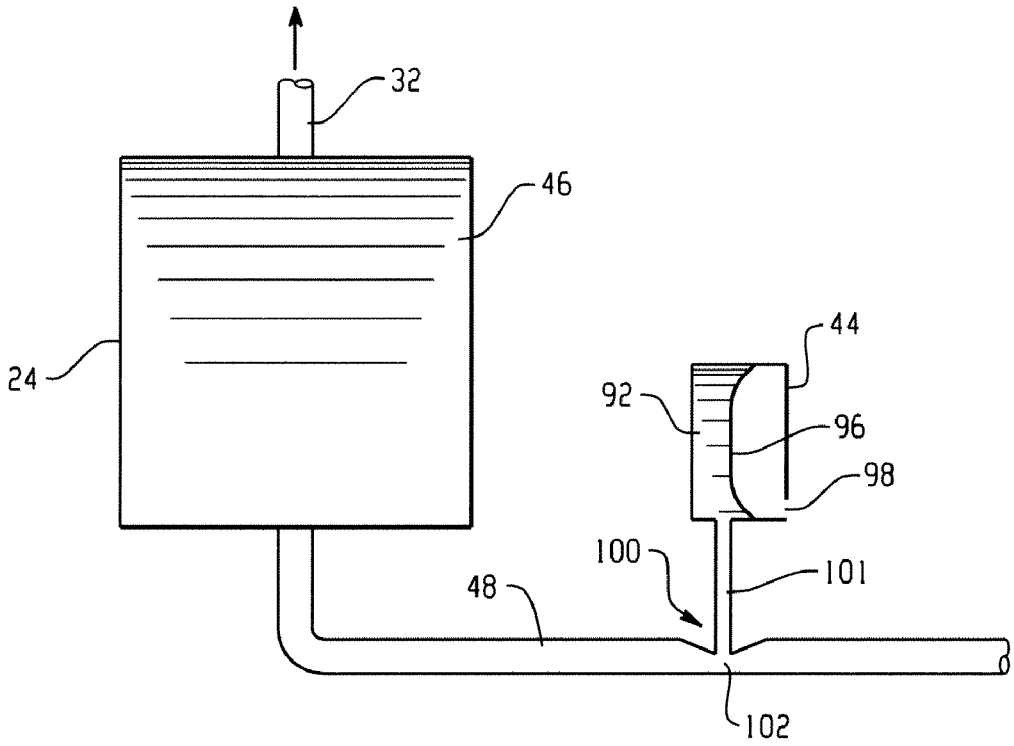
FIG. 3 is a partial schematic view of an expansion compensating device upstream of a hot water tank shown in a position where fluid within the expansion compensating device is siphoned out and directed toward the hot water tank.
Figure 4:
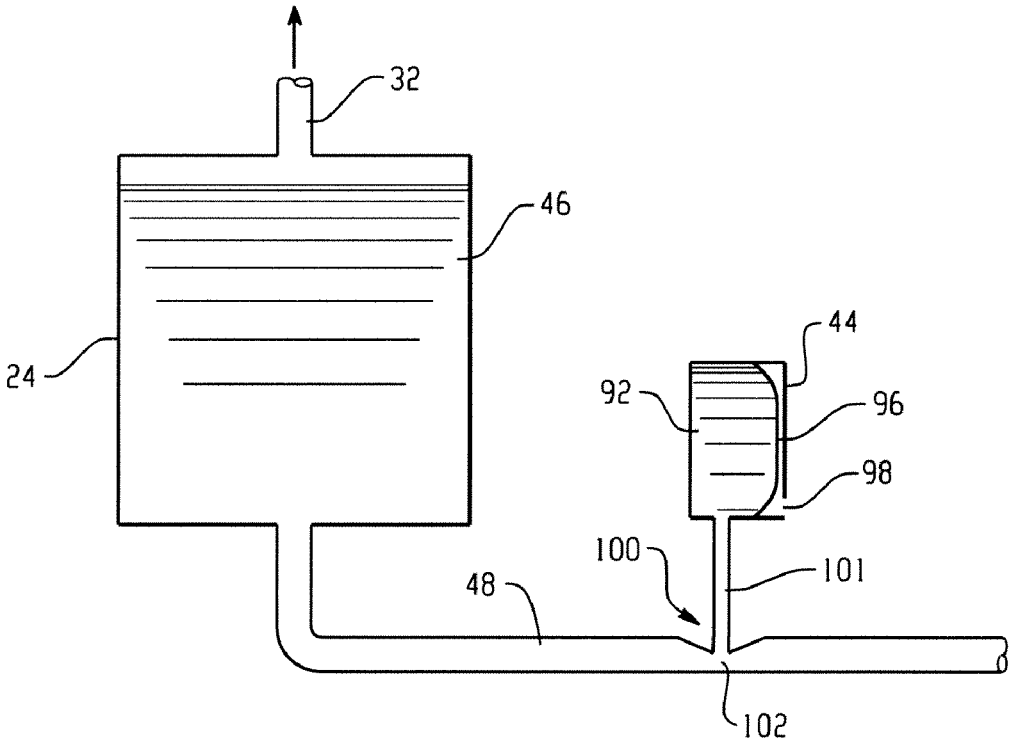
FIG. 4 is another partial schematic view of the expansion compensating device upstream of the hot water tank showing the fluid filling the expansion compensating device to lower a fluid level within the hot water tank.

With reference to FIGS. 3 and 4, a portion of the system 10 is schematically shown, and particularly a more detailed schematic view of the expansion compensating device 44 is shown according to one embodiment. As already indicated, the expansion compensating device 44 compensates for expansion of the fluid of the tank 24. In the illustrated embodiment of FIGS. 3 and 4, the expansion compensating device 44 is a retraction tank disposed upstream of the tank 24 along the fluid line 48. Within the expansion compensating device (i.e., retraction tank 44 in the embodiment illustrated in FIGS. 3 and 4), an expansion chamber 92 is included or defined. The expansion chamber 92 is at least partially defined by a movable wall portion or diaphragm 96 that allows a volume of the chamber 92 to vary. The device 44 can be vented at opening 98 in the tank 44 (or tank housing) to allow movement of the movable wall 96 without creating a vacuum effect. The expansion compensating device 44, and particularly the expansion chamber 92, is fluidly connected to the line 48 through a Venturi fluid line portion 100. Specifically, the Venturi fluid line portion 100 includes a fluid passage 101 extending between the line 48 and the chamber 92 that particularly connects with the line 48 at a reduced area portion thereof. For example, as shown, the fluid line portion 101 can connect to the fluid line 48 at a diametrically reduced section 102 of the line 48.

In operation, when fluid flow passes by the expansion tank 44 toward the tank 24, fluid from the chamber 92 is siphoned as fluid is dispensed through the outlet 26. In particular, an amount of the fluid in the expansion chamber 92 is siphoned through the Venturi fluid line portion 100 when fluid flows therepast toward the tank 24 during dispensing through the dispense outlet 26. The expansion tank 44, and particularly the expansion chamber 92, is filled by the fluid via gravity subsequent to dispensing fluid from the tank 24 to thereby reduce a fluid level within the tank 24. More specifically, an amount of water (when water is the fluid) is directed into the expansion chamber 92 through the Venturi fluid line portion 100 by gravity after dispensing through the dispense outlet 26. The movable wall or diaphragm 96 forms the expansion chamber 92 as a bladder within the tank 4. The fluid line portion 101 of the Venturi fluid line portion 100 can have a reduced diameter relative to the fluid line 48 to create the Venturi effect that fills the tank 44 after dispensing and empties the tank as the fluid flows therepast to the tank 24 during dispensing. In particular, the movable wall 96 moves toward the position illustrated in FIG. 3 as the chamber 92 is emptied during dispensing and moves toward the position illustrated in FIG. 4 when the chamber 92 is refilled after dispensing to thereby reduce a fluid level within the tank 24.

Figure 7:
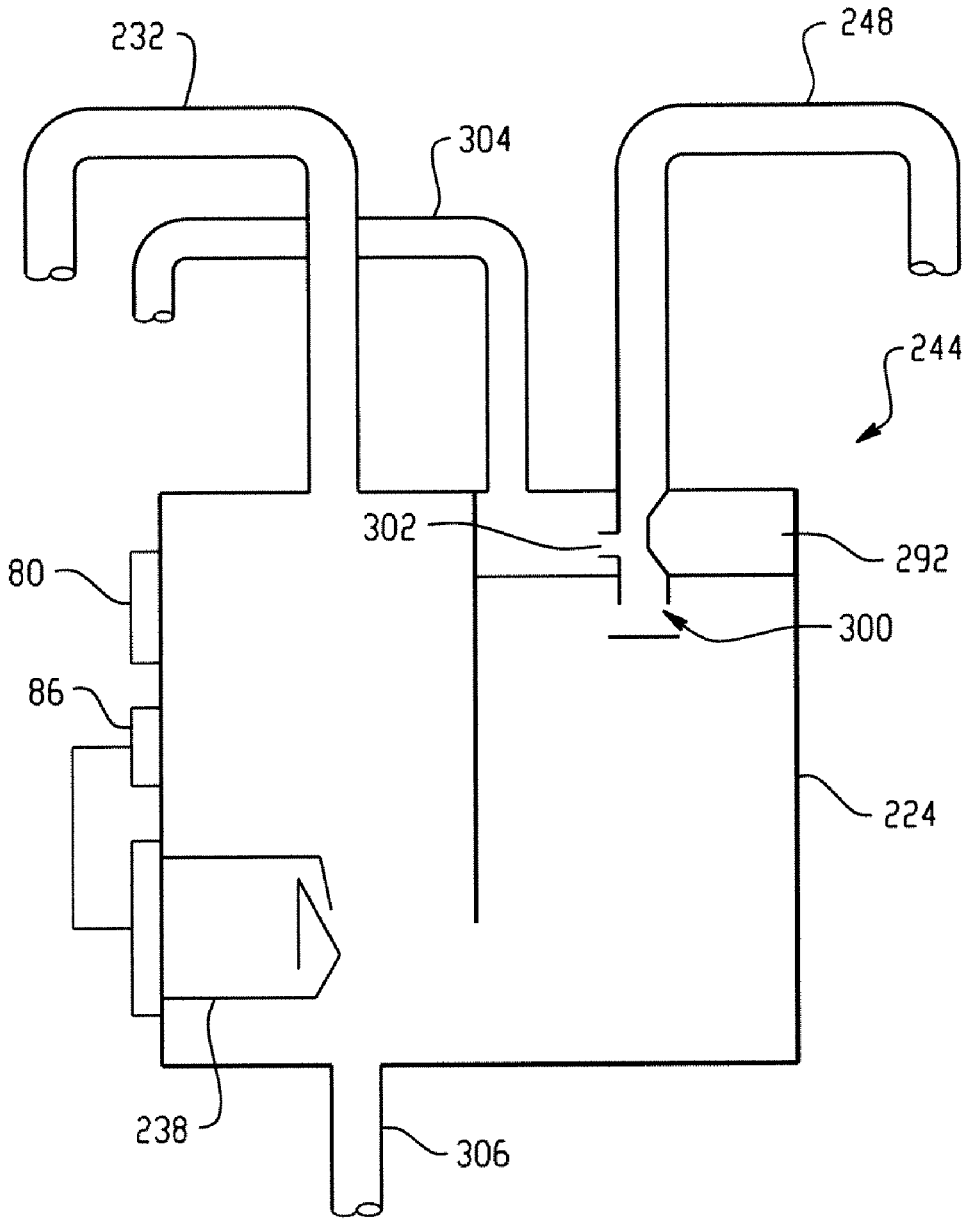
FIG. 7 is a partial schematic view showing an alternate construction for a hot fluid storage tank having an expansion compensating device integrally formed therewith.

With brief reference to FIG. 7, an alternate fluid storage tank 224 is shown for holding fluid at an elevated temperature (i.e., an alternate hot tank). The tank 224 includes an integral expansion compensating device 244 that compensates for expansion of fluid in the tank 224 when the fluid is heated by heating device 238. Unlike the heating device 38, the heating device 238 is illustrated as a heating coil, but it is to be appreciated that the heating device of tank 24 and 224 can be any heating device capable of heating the fluid within the tank to a desired temperature. Like the tank 24, the tank 224 can include a thermostatic sensor 80 and a high temperature cutout device 86 for operating in conjunction with a controller, such as controller 62, to safely heat fluid within the tank 224 to a desired temperature.

In the tank 224, an expansion chamber 292 of the expansion compensating device 244 is integrally formed as a portion of the tank 224 and is a fixed volume. In particular, an inlet line 248 delivers fluid to the tank 224 and passes through the expansion chamber 292 as shown. A Venturi fluid line portion 300 can be provided along the line 248 within the expansion chamber 292. In particular, the Venturi fluid line portion 300 includes a reduced diameter portion of the line 248 and a fluid channel 302 having a diameter smaller than an adjacent cross sectional area of the line 248. This causes siphoning of fluid from the chamber 292 when fluid flow passes from the line 248 through the tank 224 and to a dispenser, such as dispenser 26, along outlet line 232 and fills the expansion chamber 292 subsequent to dispensing fluid from the tank 224 to the dispenser outlet. A vent line 304 in fluid communication with the expansion chamber 292 can be provided for allowing variations in the level of fluid contained within the chamber 292. As shown, a drain 306 can also be provided for the tank 224.

Returning reference to the embodiment illustrated in FIG. 1, the proportioning device 28 includes a mixing valve 108 fluidly connected to each of the tanks 22,24 via lines 30,32. The mixing valve 108 adjustably regulates fluid flow from each of the tanks 22,24 to proportion the fluid delivered to the dispenser outlet 26. A valve controller 110 can be provided in association with the mixing valve 108 for control thereof based on a control signal 112 sent from the controller 62 to the proportioning device 28. In an exemplary embodiment, the mixing valve 108 can be a paddle mixing valve, including a housing, a cover, a stepper motor and a paddle, as is known and understood by those skilled in the art. In particular, the lines 30,32 can be connected to the housing of the paddle-type mixing valve and the paddle disposed therein is selectively moved by the stepper motor for covering inlet openings into the housing for purposes of producing the desired flow rate from each of the tanks 22,24 to thereby pass fluid at a desired temperature along line 34 to the outlet 26.

Alternatively, the mixing valve 108 can be a slider mixing valve or a magnetic three-way valve (or some other type of mixing valve). If a sliding mixing valve, the mixing valve 108 could include a stepper motor, a housing, a shaft and O-rings. The lines 30,32 could then be attached to the housing wherein the stepper motor would turn the shaft to adjust one or more O-rings of the valve to locations over an outlet port that allows for a desired mixture of fluid from the tanks 22,24. Of course, as will be understood and appreciated by those skilled in the art, any type of mixing valve could be used for the valve 108 for purposes of selectively mixing fluid from the tanks 22,24 to deliver fluid to the dispenser outlet 26 at a desired temperature.

Figure 5:
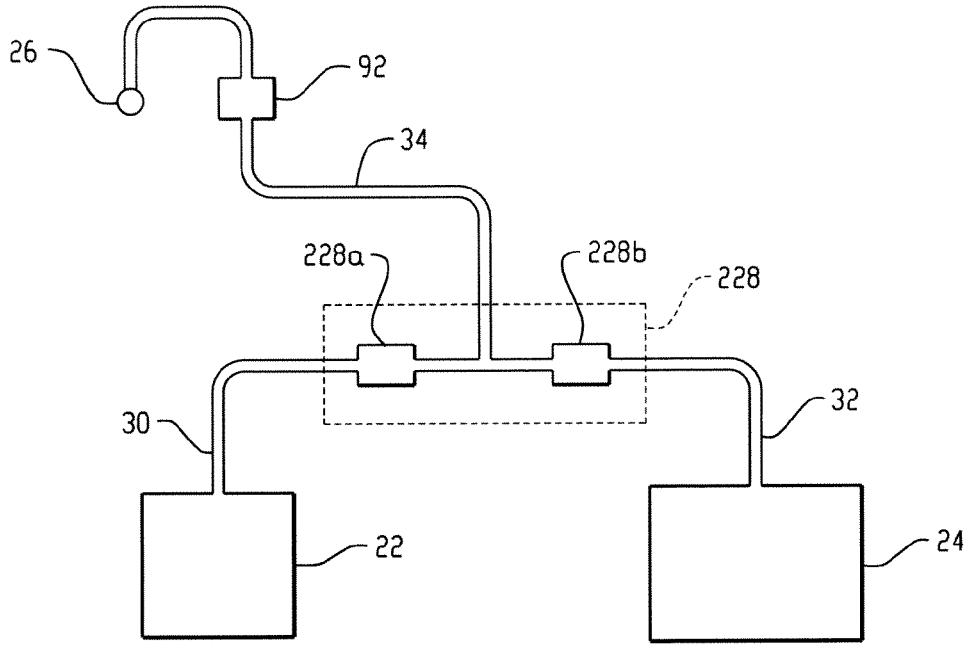
FIG. 5 is a partial schematic view showing the proportioning device as a pair of proportioning valves for respectively proportioning fluid from hot and cold fluid tanks prior to delivery of the fluid to a dispenser outlet.

With reference to FIG. 5, an alternate proportioning device 280 is shown that can be substituted within the system 10 of FIG. 2 (i.e., the proportioning device 280 can replace the device 28 interconnecting fluid lines 30,32 and 34). In FIG. 5, the proportioning device 228 includes a first proportioning valve 228*a* and a second proportioning valve 228*b*. In this arrangement, the proportioning valves 228*a*,228*b* are respectively placed on lines 30,32 to adjust the flow rate from the tanks 22,24 to obtain desired mixing. As shown, after the proportioning valves 228*a*,228*b*, the lines 30,32 are spliced together or rejoined and commonly directed to line 34. More particularly, the first proportioning valve 228*a* adjustably regulates fluid flow from the tank 22 and the second proportioning valve 228*b* adjustably regulates fluid flow from the tank 24, both to the dispenser outlet 26.

Figure 6:
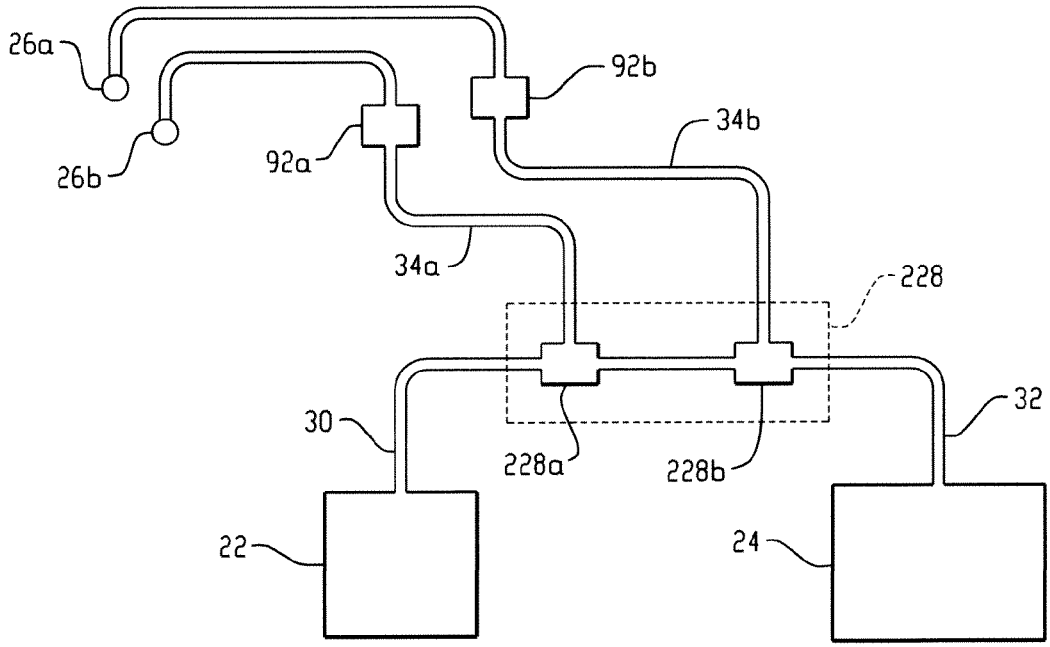
FIG. 6 is a partial schematic view showing the proportioning device as a pair of proportioning valves like FIG. 5, but arranged to separately deliver for the proportioned fluid from the hot and cold fluid tanks to respective fluid outlets.

Alternatively, as shown in FIG. 6, the proportioning device 228 can be used in an arrangement employing dual dispensing outlets. More particularly, as shown, no splicing or joinder of the fluid exiting the proportioning valves 228*a*,228*b* occurs. Rather, line 34 and dispenser outlet 26 are replaced with separate lines 34*a*,34*b* and dispenser outlets 26*a*,26*b*. Each of the lines 34*a*,34*b* includes its own expansion chamber or device 92*a*,92*b*. In this manner, actual mixing of fluids from the tanks 22,24 does not occur until dispensing through the dispenser outlets 26*a*,26*b*.

Returning to FIGS. 1 and 2, a user interface 114 can be provided for allowing selection of a specific temperature at which fluid from the system 10 is to be dispensed at the dispenser outlet 26. In particular, the user interface 114 enables selection of a specific temperature at which fluid (e.g., water) is to be dispensed through the dispenser outlet 26. The specific temperature is communicated to the controller 62 via signal 116. The controller sends an appropriate signal 112 to the proportioning device 28 for proportioning delivery of the fluid from the tanks 22,24 to dispense through the dispenser outlet 26 at the selected specific temperature, while also sending signal 66 to the valve 64 to dispense the fluid through the system 10 using the pressure from the fluid source 50.

In operation, a user selects a specific temperature on the user interface 114 for fluid or water to be dispensed through the dispenser outlet 26 from the tanks 22,24. The selected specific temperature is sent to the controller 62 via the signal 116. Subsequently, upon receipt of dispense signal 74 from actuation of the dispense actuator 42, the controller 62 sends command signal 66 to the valve 64 to allow fluid flow from the fluid source 50 through the valve 64 to the tanks 22,24 and ultimately to the dispenser 26. During such dispensing from the tanks 22,24, the proportioning device 28 proportions the fluid from the tanks to the outlet 26 to correspond to the selected specific temperature.

The exemplary embodiment or embodiments have been described with reference to preferred embodiments. Obviously, modifications and alterations will occur to others upon reading and understanding the preceding detailed description. It is intended that the exemplary embodiments be construed as including all such modifications and alterations insofar as they come within the scope of the appended claims or the equivalents thereof.

What is claimed is:

1. A variable temperature dispenser system for dispensing a fluid, comprising:

a first fluid storage tank for holding the fluid at one temperature;

a second fluid storage tank for holding the fluid at another temperature that is elevated relative to said one temperature of the first fluid storage tank;

a dispenser outlet fluidly connected to the first and second fluid storage tanks by at least one fluid line;

a proportioning device disposed along said at least one fluid line between said dispenser outlet and said first and second fluid storage tanks to proportion the fluid delivered from said first and second fluid storage tanks to said dispenser outlet; and, an expansion compensating device including a movable wall to compensate for expansion of the fluid in said second fluid storage tank when the fluid contained in said second fluid storage tank is heated.

2. The variable temperature dispenser system of claim 1 wherein said second fluid storage tank includes a heating device for heating the fluid in said second fluid storage tank to a predetermined temperature.

3. The variable temperature dispenser system of claim 1 wherein said expansion compensating device is a retraction tank disposed upstream of said second fluid storage tank along said at least one fluid line.

4. The variable temperature dispenser system of claim 3 wherein fluid flow passing by said retraction tank toward said second fluid storage tank results in siphoning of the fluid from said retraction tank as the fluid is dispensed from said second fluid storage tank and filling said retraction tank via gravity subsequent to dispensing the fluid from said second fluid storage tank to reduce a fluid level in said second fluid storage tank.

5. The variable temperature dispenser system of claim 4 wherein said movable wall forms a bladder within said expansion tank, a fluid line between said at least one fluid line and said expansion compensating device having a reduced diameter relative to at least an adjacent portion of said at least one fluid line to create a Venturi effect for emptying said expansion tank as fluid flows therepast.

6. The variable temperature dispenser system of claim 1 wherein said proportioning device includes a mixing valve fluidly connected to each of said first and second fluid storage tanks by said at least one fluid line, said mixing valve adjustably regulating fluid flow of said fluid from each of said first and second fluid storage tanks to proportion the fluid delivered to said dispenser outlet.

7. The variable temperature dispenser system of claim 6 wherein said mixing valve is one of a paddle valve, a slider valve, and a magnetic three-way valve.

8. The variable temperature dispenser system of claim 1 wherein said proportioning device includes a first proportioning valve and a second proportioning valve, said first proportioning valve adjustably regulating fluid flow from said first fluid storage tank to said dispenser outlet and said second proportioning valve adjustably regulating fluid flow from said second fluid storage tank to said dispenser outlet.

9. The variable temperature dispenser system of claim 8 wherein said dispenser outlet includes a first outlet for dispensing the fluid from said first fluid storage tank passed through said first proportioning valve and a second outlet for dispensing the fluid from said second fluid storage tank passed through said second proportioning valve.

10. The variable temperature dispenser system of claim 1 further including a user interface that allows selection of a specific temperature at which the fluid is to be dispensed at said dispenser outlet, said proportioning device proportioning delivery of the fluid from said first and second fluid storage tanks to dispense the fluid through said dispenser outlet at said specific temperature.

11. variable temperature system for dispensing a fluid comprising:

a first fluid storage tank for holding the fluid at one temperature;

a second fluid storage tank for holding the fluid at another temperature that is elevated relative to said one temperature of the first fluid storage tank;

a dispenser outlet fluidly connected to the first and second fluid storage tanks by at least one fluid line, wherein said dispenser outlet is disposed on a refrigerator door and said first and second fluid storage tanks are housed in said refrigerator door, and said fluid dispensed through said dispenser outlet on said refrigerator door is water;

a proportioning device disposed along said at least one fluid line between said dispenser outlet and said first and second fluid storage tanks to proportion the fluid delivered from said first and second fluid storage tanks to said dispenser outlet; and, an expansion compensating device including a movable wall to compensate for expansion of the fluid in said second fluid storage tank when the fluid contained in said second fluid storage tank is heated.

12. A variable temperature water dispenser system for dispensing water from a refrigerator, comprising:

a hot water tank for holding water at a first temperature;

a cold water tank for holding water at a second, lower temperature;

a dispenser outlet for dispensing proportioned amounts of water from said hot and cold water tanks;

dispenser fluid lines fluidly connecting said hot and cold water tanks to said dispenser outlet;

a proportioning device fluidly disposed between each of said hot and cold water tanks and said dispenser outlet for proportioning the respective amounts of water dispensed at said dispenser outlet from said hot and cold water tanks; and, an expansion compensating device disposed fluidly upstream of said hot water tank for compensating for expansion of water when heated in said hot water tank.

13. The variable temperature dispenser system of claim 12 wherein said expansion compensating device includes an expansion chamber fluidly connected to said dispenser fluid lines through a Venturi fluid line portion, an amount of water in said expansion chamber siphoned through said Venturi fluid line portion when water flows therepast toward said hot water tank during dispensing through said dispense outlet and an amount of water directed into said expansion chamber through said Venturi fluid line portion by gravity after dispensing through said dispense outlet.

14. The variable temperature dispenser system of claim 13 wherein said expansion chamber is a fixed volume and is vented.

15. The variable temperature water system of claim 12 wherein said dispenser fluid lines include at least one expansion chamber adjacent said dispenser outlet downstream of said proportioning device to purge any air trapped in said dispenser fluid lines prior to dispensing said-water through said dispenser outlet.

16. The variable temperature water system of claim 12 further including a user interface enabling selection of a specific temperature at which water is to be dispensed through said dispenser outlet, said proportioning device proportioning delivery of water from said hot and cold water tanks to dispense water through said dispenser outlet at said specific temperature.

17. A method for dispensing a variable temperature controlled fluid in an appliance, comprising:

selecting a specific temperature for water to be dispensed through a dispenser outlet from a hot water tank and a cold water tank;

proportioning water from said hot water tank and said cold water tank to deliver said water at said dispenser outlet at said specific temperature;

siphoning the water as the water is dispensed from said hot water tank; and reducing a level of the water in said hot water tank after said dispensing.

18. The method of claim 17 further including:

heating said water in said hot water tank; and compensating for thermal expansion of said water in said hot water tank during heating thereof.

* * * * *